US005305881A

United States Patent [19]

Caldwell et al.

[11] Patent Number: 5,305,881

[45] Date of Patent: Apr. 26, 1994

[54] DISPENSER FOR FABRIC SOFTENER SHEETS

[75] Inventors: Lawrence W. Caldwell, Hanover, Pa.; James M. Kittle, Jr., Milwaukee, Wis.; James Stone, Grand Rapids, Mich.; Kara Sturdy, Reisterstown, Md.; Kenneth Zylka, Grafton, Wis.

[73] Assignee: Lever Brothers Company, Division of Conopco, Inc., New York, N.Y.

[21] Appl. No.: 880,765

[22] Filed: May 8, 1992

Related U.S. Application Data

[63] Continuation-in-part of Ser. No. 805,275, Dec. 10, 1991.

[51] Int. Cl.[5] ..... B65D 85/62

[52] U.S. Cl. ..... 206/494; 221/63; 252/8.6

[58] Field of Search ..... 206/0.5, 205, 494, 812; 229/230-232; 252/8.6-8.9, 90; 221/63; 427/242

[56] References Cited

U.S. PATENT DOCUMENTS

| | | | |
|---|---|---|---|
| D. 268,649 | 4/1983 | Adamson et al. . | |
| D. 269,068 | 5/1983 | Mann, Sr. et al. . | |
| D. 270,041 | 8/1983 | Vestal . | |
| 1,910,409 | 5/1933 | Schwartzberg . | |
| 1,948,181 | 2/1934 | Medoff | 229/230 |
| 1,988,582 | 1/1935 | Weiss . | |
| 2,009,464 | 7/1935 | Winter . | |
| 2,020,799 | 11/1935 | Randall . | |
| 2,115,673 | 4/1938 | Stompe . | |
| 2,126,106 | 8/1938 | Goldberg . | |
| 2,334,536 | 11/1943 | Broeren et al. . | |
| 2,473,492 | 6/1949 | Shina . | |
| 2,529,853 | 11/1950 | Taggart . | |
| 2,651,409 | 9/1953 | Fay . | |
| 2,656,916 | 10/1953 | Henderson . | |
| 2,973,086 | 2/1961 | Thompson . | |
| 3,047,141 | 7/1962 | Burns . | |
| 3,167,238 | 1/1965 | Smith . | |
| 3,207,361 | 9/1965 | Marcalus . | |
| 3,224,632 | 12/1965 | Marcalus . | |
| 3,326,364 | 6/1967 | Waldrop et al. . | |
| 3,583,597 | 6/1971 | Buttery . | |
| 3,639,937 | 2/1972 | Sweeney . | |
| 3,696,034 | 10/1972 | Hewitt et al. . | |
| 3,737,095 | 6/1973 | Derauf . | |
| 3,819,043 | 6/1974 | Harrison . | |
| 3,895,128 | 7/1975 | Gaiser . | |
| 3,944,694 | 3/1976 | McQueary . | |
| 3,982,685 | 9/1976 | Shimada . | |
| 4,044,919 | 8/1977 | Olson . | |
| 4,170,678 | 10/1979 | Urfer et al. . | |
| 4,200,200 | 4/1980 | Hein, III et al. . | |
| 4,201,291 | 5/1980 | Davidson . | |
| 4,221,304 | 9/1980 | Wahl et al. . | |
| 4,405,078 | 9/1983 | Dutcher et al. . | |
| 4,413,769 | 11/1983 | Michetti . | |
| 4,416,369 | 11/1983 | Burns . | |
| 4,417,661 | 11/1983 | Roccaforte . | |
| 4,423,105 | 12/1983 | Dillarstone et al. . | |
| 4,459,127 | 7/1984 | Kunzel . | |
| 4,502,514 | 3/1985 | Ballard et al. . | |
| 4,512,476 | 4/1985 | Herrington, Jr. . | |
| 4,513,862 | 4/1985 | Mallow . | |
| 4,623,074 | 11/1986 | Dearwester . | |
| 4,648,510 | 3/1987 | Kuenzel . | |
| 4,714,191 | 12/1987 | Richardson . | |
| 4,714,643 | 12/1987 | Kuenzel . | |
| 4,733,774 | 3/1988 | Ping, III et al. . | |
| 4,735,738 | 4/1988 | Willman . | |
| 4,745,021 | 5/1988 | Ping, III et al. . | |
| 4,746,019 | 5/1988 | Prater | 229/232 |
| 4,765,508 | 8/1988 | Poppe . | |
| 4,805,800 | 2/1989 | Nocek et al. . | |
| 4,817,790 | 4/1989 | Porat et al. . | |
| 4,865,204 | 9/1989 | Vance . | |
| 4,882,917 | 11/1989 | Mizusawa et al. . | |
| 5,054,612 | 10/1991 | Meyer, Jr. . | |
| 5,054,619 | 10/1991 | Muckenfuhs . | |
| 5,085,323 | 2/1992 | Kuchenbecker et al. . | |
| 5,123,589 | 6/1992 | Cote | 229/232 |

FOREIGN PATENT DOCUMENTS

| | | |
|---|---|---|
| 622873 | 5/1963 | Canada . |
| 20522 | 3/1910 | Denmark . |
| 352534 | 1/1990 | European Pat. Off. . |

*Primary Examiner*—Jimmy G. Foster
*Attorney, Agent, or Firm*—Gerard J. McGowan, Jr.

[57] ABSTRACT

A carton for housing sheets, particularly dryer sheets. The dryer sheets are preferably stacked in a "U" shape and are removed via an access flap which may include 2 hinges and may be reclosable. The ratio of the length of the horizontal axis of the access flap is preferably of a defined ratio to the width of the sheet.

10 Claims, 14 Drawing Sheets

FIG. 4
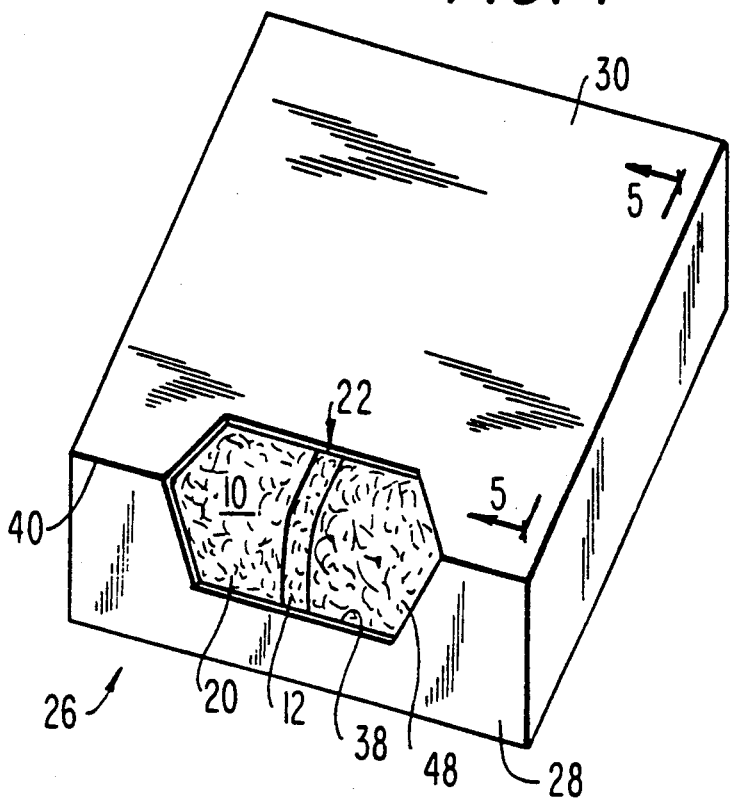
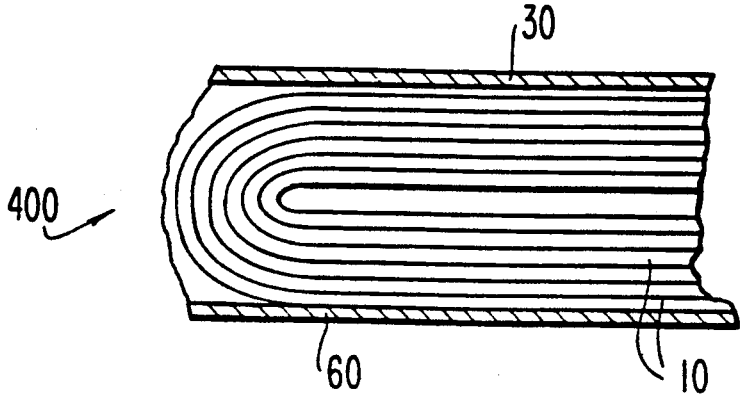
FIG. 5

DISPENSER FOR FABRIC SOFTENER SHEETS

This is a continuation-in-part of U.S. patent application Ser. No. 805,275, filed Dec. 10, 1991.

BACKGROUND OF THE INVENTION

One method of applying fabric softener to clothes utilizes sheets impregnated with fabric softening materials. These sheets may be readily placed in the dryer with the clothes. During drying the fabric softening actives and optionally other materials, such as perfumes, are transferred to the clothes.

Previously, fabric softener sheets have generally been provided to consumers in the form of a roll. Individual sheets are formed by separating the sheets from the roll at lines of weakness provided at intervals along the roll. Perforations do not always perform reliably to give a clean separation with exertion of minimal force, particularly where the sheet is sufficiently durable to survive the temperatures and tumbling action of a clothes dryer.

Additional problems associated with the use of dryer sheets include the escape of fragrance from the carton prior to use.

Sheets of various shapes are known for use in household products. Individually folded dove tail sheets are known for products such as dusting cloths.

SUMMARY OF THE INVENTION

The present invention concerns the dispensing of dryer sheets which are stacked and dispensed as individual sheets rather than torn from a roll. In accordance with the present invention, the sheets are dispensed from a stack wherein a substantial number of sheets are offset from the majority of the sheets along the surface of the sheets facing the opening of the carton so that the stack has an effective distance along the surface facing the opening which is generally greater than the distance along the surface for any of the sheets. This permits the opening in the carton to be wider relative to the surface of the individual sheets facing it than would otherwise be possible, consistent with effective containment of the sheets by the carton when the carton is open. This is advantageous in that a wider opening relative to the size of the individual sheets facilitates removal of the sheets. Typically, the end-to-end distance of the surface facing the opening is the width of the sheet and of the stack.

Use of the sheets is facilitated by providing each individual sheet with a dove tail fold which can be readily grasped. In another aspect of the invention, the stacking arrangement is advantageously used in conjunction with a carton opening which is hinged along the bottom score line of the front panel and which includes a square or rectangular opening in the front panel and a further opening in the top panel. The hinge on the bottom panel results in the opening flap lying away from the opening and in a position where it does not tend to obstruct the opening when pulling out a sheet.

In accordance with a preferred embodiment wherein the sheets are stacked within the carton in a generally "U" shape folded along their transverse axes, the width of the carton aperture at the bight of the fully loaded stack of sheets is advantageously such that the ratio of the width of the carton opening at that point to the width of the stack of sheets along the surface of the stack facing the opening is within the range of about 0.55 to about 0.76, preferably about 0.7 to about 0.75.

In a further embodiment, a hexagonal aperture spans portions of both the top and front carton panels. The aperture is wide at the middle and narrows toward the top and bottom for easy grasping of the sheet and pulling through the wide middle without inordinate escape of perfume. The narrowness of the opening at the top and bottom should restrict the escape of perfume.

In a still further embodiment, the aperture in the carton through which access to product is provided to the consumer is reclosable by means of a double jointed flap. The double jointing of the flap eases reclosure of the carton as well as opening of the flap.

The invention eliminates the need for a fiberboard or other core material around which the rolls of fabric softener sheets have been wrapped. In the past, when the roll was empty such cores were discarded, resulting in additional waste to be contributed to the environment. The present invention does not require a core or other supporting insert and permits use of less shelf space. Also, the invention removes the need for the steps employed by the consumer to tear a sheet cleanly from the remaining sheets on the roll.

For a more complete understanding of the above and other features and advantages of the invention, reference should be made to the following detailed description of preferred embodiments and to the accompanying drawings.

BRIEF DESCRIPTION OF THE DRAWINGS

FIG. 4 is a perspective view of the combined carton and sheets of the invention of FIG. 3.

FIG. 5 is a cross-section along the lines 5—5 of FIG. 4.

DETAILED DESCRIPTION OF THE INVENTION

The sheets 10 are fabricated from a durable, woven or non-woven material which will be normally be a fibrous polymeric material such as polyester or rayon. If desired, the material may have a melting point such that it will not melt at temperatures prevalent in clothes dryers. Typically, the melting point of the sheet will be above about 220° C. The sheet is impregnated with materials suitable for transfer to the clothes during drying to provide a softening effect. Materials suitable for use in fabric softening sheets are described in Rudy et al. U S. Pat. Nos. 4,421,792; 4,327,133; 4,238,531; 4,012,326 and 3,972,131, the disclosures of which are incorporated herein by reference, among others.

Figure 1:
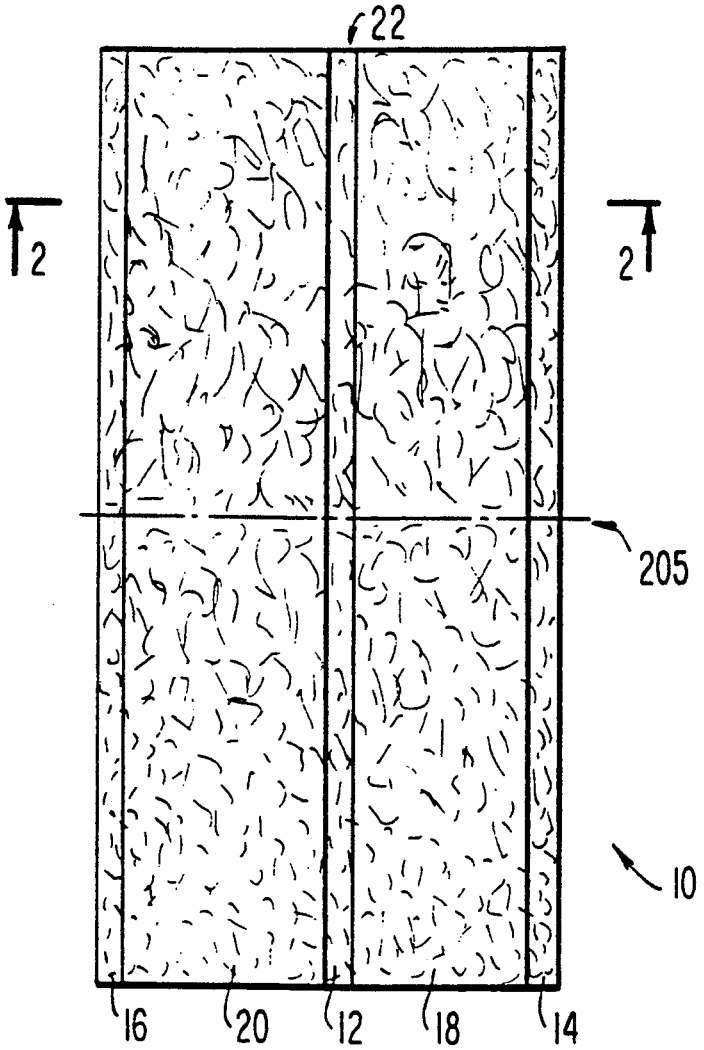
FIG. 1 is a top plan view of a dryer sheet of the invention.
Figure 2:
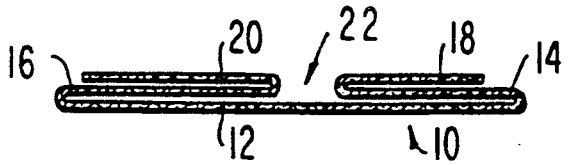
FIG. 2 is a cross-section along the lines 2—2 of FIG. 1.

The sheet is provided with a dove tail fold, as can best be seen in FIGS. 1 and 2. The essence of the dove tail fold is that the sheet includes a flat bottom layer, intermediate layers formed by medial folds on each of the sides of the flat bottom layer and at least one and preferably two top layers folded laterally away from the center of the sheet. Ideally, an appreciable space or gap is left between the medial edges of the top layer.

The dove tail folds of the sheet 10 can be seen particularly in FIG. 2 wherein the flat bottom layer is denoted by reference number 12 and is folded medially to form two intermediate layers 14 and 16 which in turn are folded laterally to form two top layers 18 and 20. An appreciable gap 22 is left between the medial edges of the folds which form the top layers 18 and 20.

The folds are effected using equipment such as an SRI machine available from Accratec of Neenah, Wis.

Figure 3:
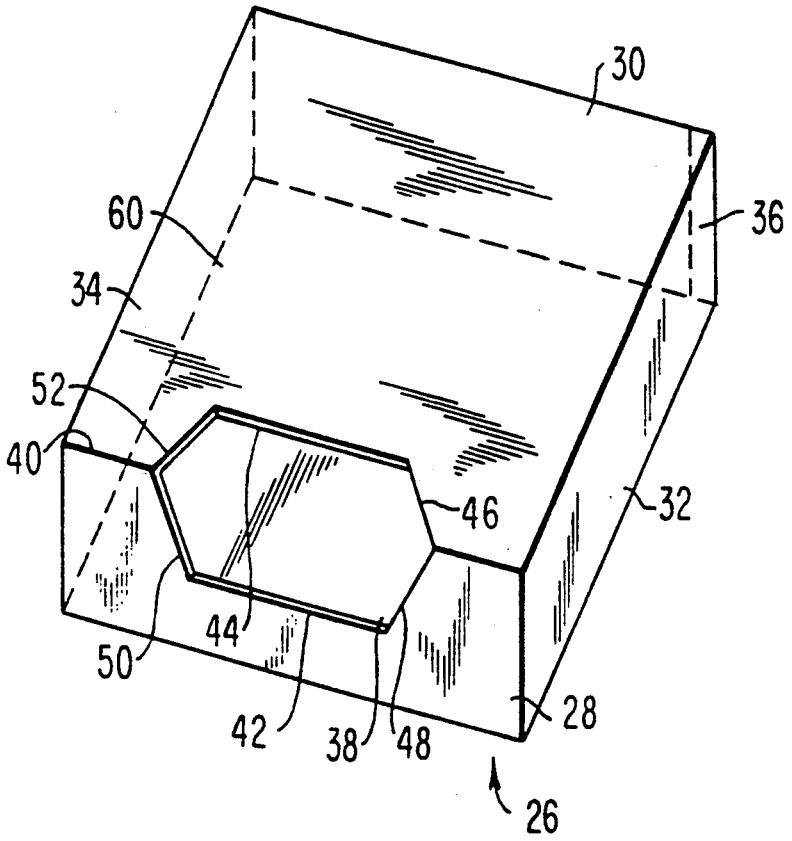
FIG. 3 is a perspective view of an erected carton according to one embodiment of the invention.

As seen particularly in FIG. 3, carton 26 includes front panel 28, rear panel 30, first side panel 32, second side panel 34 and gluing flap 36. Aperture 38 is hexagonal and straddles score line 40 which separates top panel 30 from front panel 28. Aperture 38 extends through portions both of front panel 28 and top panel 30.

To conserve perfume, the carton 26 may be provided to the consumer with perforations defining the aperture so that the consumer can remove those portions of top and front panels 30 and 28 defined by the perforations to open the carton and form the aperture. This is for conserving perfume and minimizing its release into the air surrounding the carton while the carton is stored prior to use.

Cut lines 42 and 44, which extend parallel to score line 40, are appreciably smaller than the horizontal axis of the aperture (along score line 40). This provides the aperture with a wide opening in the middle yet with a restricted area at the top and bottom, for better containment of the perfumes.

In FIG. 4, the carton 26 is shown having sheets 10 inserted therein. The sheets are inserted so that the gap 22 is centrally located within aperture 38. The sheets are folded along their transverse axes 205 roughly halfway between the top and the bottom of the sheet (see FIGS. 1 and 5). Preferably, the sheets are not interleaved but lie adjacent to each other without any interlocking of the folded layers between adjacent sheets. The sheets are preferably not disposed within the folds of any adjacent sheets. The absence of interleaving is to result in less loss of perfume and exposure of the sheets to the air since interleaving would cause partial removal of the subsequent sheet after removal of the previous one.

No insert is required within the carton to support the stack. The stack preferably folds only in the "U"-shape; the arms of the U do not themselves fold again along a transverse axis of the sheets. The sheets do not require any starting strips to remove the first or subsequent sheets from the carton. The first sheet is identical to subsequent sheets.

When the consumer wishes to use one of the sheets, he/she simply grasps the sheet through the aperture 38 at one of the folds which forms the upper and intermediate sheets. Grasping of the sheet is facilitated by the presence of gap 22. The long axis of the aperture along score line 40 facilitates removal of the sheet whereas the minimized vertical dimension of the aperture from top to bottom as reflected in the decreased length of cuts 42 and 44 relative to the longitudinal axis through the score line and the angle of the cuts are to minimize the escape of perfume through the aperture. The "U" fold of the sheets also facilitates removal.

A carton according to one embodiment is illustrated in FIGS. 6–9. Carton 126 comprises front panel 128, outer major side flap 132, inner major side flap 133, second outer major side flap 134, second inner major side flap 135, rear panel 131 and bottom panel 160. Perforated lines 111 define a product access flap 115 which is permanently joined to the top panel 130 by score line 117. As can be seen particularly in FIG. 6, access flap 115 comprises portions both of front panel 128 and top panel 130, including a portion of score line 140 which separates the top from the front panels.

In accordance with one aspect of the invention, the access flap is specially designed so that when the dryer sheets are fully loaded within the carton in the "U" orientation wherein the bight or inflection point 400 faces the access opening, the ratio of the access opening to the width of the stack of dryer sheets or the width of the stack of sheets is within a defined range. In particular, it is preferred that the ratio is within the range of about 0.55 to about 0.76, especially about 0.7 to about 0.75, and most preferably about 0.73 to about 0.74. Design of the carton in accordance with the above ratios is to facilitate removal of the sheets by the consumer and to minimizing the size of the opening for decreasing escape of perfume and premature exiting of the sheets from the carton.

The ratio of the area of the plane of the folded sheet or the ratio of the area of the plane encompassing the overall width of the stack of folded sheets to the area of the access opening is preferably within the range of 1:2.5 to 1:5.0.

Advantageously, access flap 115 includes 2 hinges. Both score lines 117 and 140 of the access flap serve as hinges. The advantage of the second hinge will be apparent from the description below.

Figure 7:
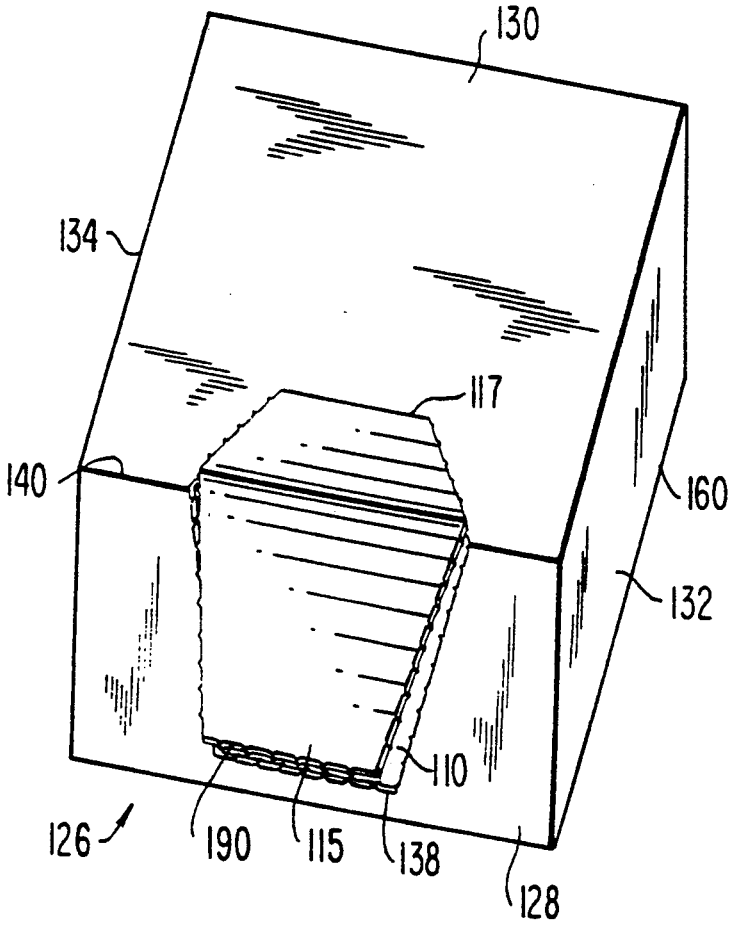
FIG. 7 is a perspective view of the carton of FIG. 6 having the access flap partially open.

When it is desired to use one of the fabric softener sheets, the consumer will push against the bottom of access flap 115. Perforations 111 will permit severance of the connections between the access flap and the front panel 128 and top panel 130 except for score line 117 wherein the access flap will remain attached to the top panel. Once the perforations have been severed, the flap will remain opened as seen in FIG. 7. Behind flap 115, dryer sheet 110 can be seen.

Figure 8:
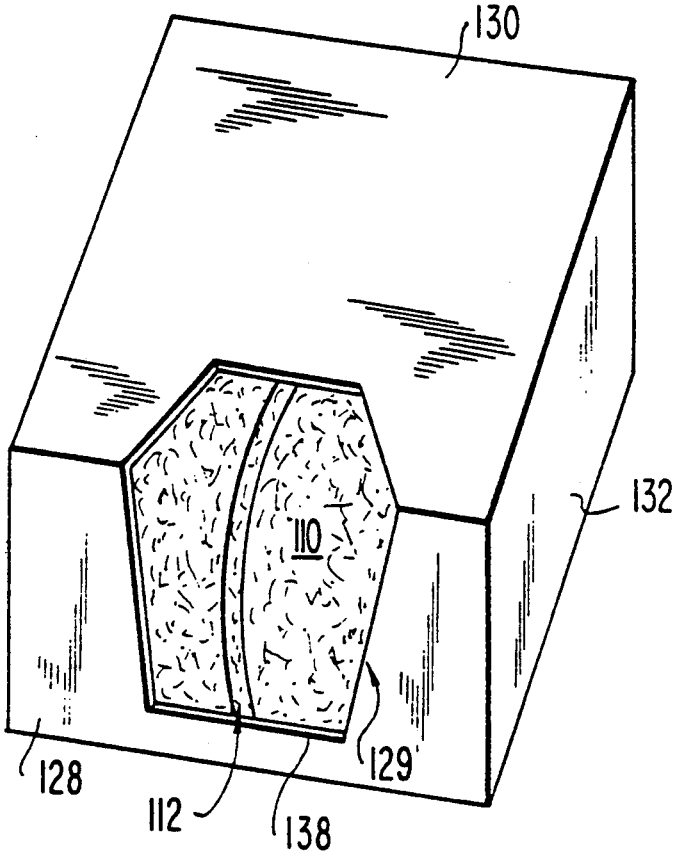
FIG. 8 is a perspective view of the carton of FIG. 6 having the access flap completely removed for purposes of illustration.

Severance of the perforations 111 creates a product access opening 138 best seen in FIG. 8. When the consumer desires to remove a sheet, he/she will hold back the access flap 115 against the top 130 of the carton and grasp the fabric softening sheet at gap 112 as described hereinbefore with respect to the earlier embodiment. The width of the access opening at 129, which constitutes the bight of the full stack of dryer sheets is within the ratio defined above to facilitate removal of the sheets.

For a 20 sheet carton, the height of the carton would typically be 1⅜ inches, the length 4 ⅝ inches and the width 4½ inches. For a 20 sheet carton, the height could be expected to be within the range of from 1 to 1½ inches. For a 40 sheet carton, the height would typically be 2¼ inches, and the length and width the same as for the 20 sheet carton. The height could vary from 2 to 2½ inches. For the 60 sheet carton, the height could be 3 inches, ranging from 2⅜ inches to 3¼ inches. The length and width would be as for the other cartons.

Figure 9:
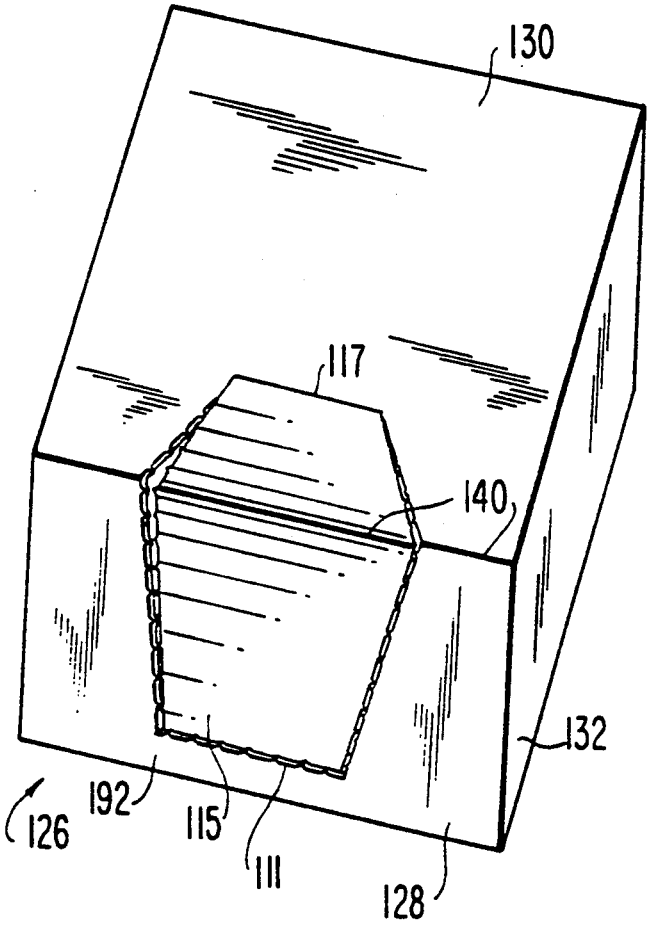
FIG. 9 is perspective view of the carton of FIG. 6 which is reclosed in accordance with the present invention.

When the consumer has removed the dryer sheet from the carton, the carton may be reclosed by grasping access flap 115 and pushing it downwardly inside aperture 138 as shown in FIG. 9. The presence of the two hinges permits the access flap readily to stay within the access aperture when so positioned. The bottom edge 190 of access flap 115 stays behind the lower aspects 192 of front panel 128 thereby keeping the carton closed when not in use. Score line 117 also functions as a hinge by permitting the access flap to pivot and thereby open and close. Score line 117 also permits the access flap to become disposed slightly rearwardly within the carton upon reclosure so that access flap 115 is positioned securely behind lower aspect 192 of front panel 128. Score line 140 serves as a second hinge to permit the access flap portion therebelow to pivot and rest comfortably and securely behind lower aspect 192 of the front panel 128.

The use of a reclosable flap is to minimize unwanted escape of perfume into the air when the sheets are not being used and helps protect the sheet from moisture and other elements in the air.

Figure 10:
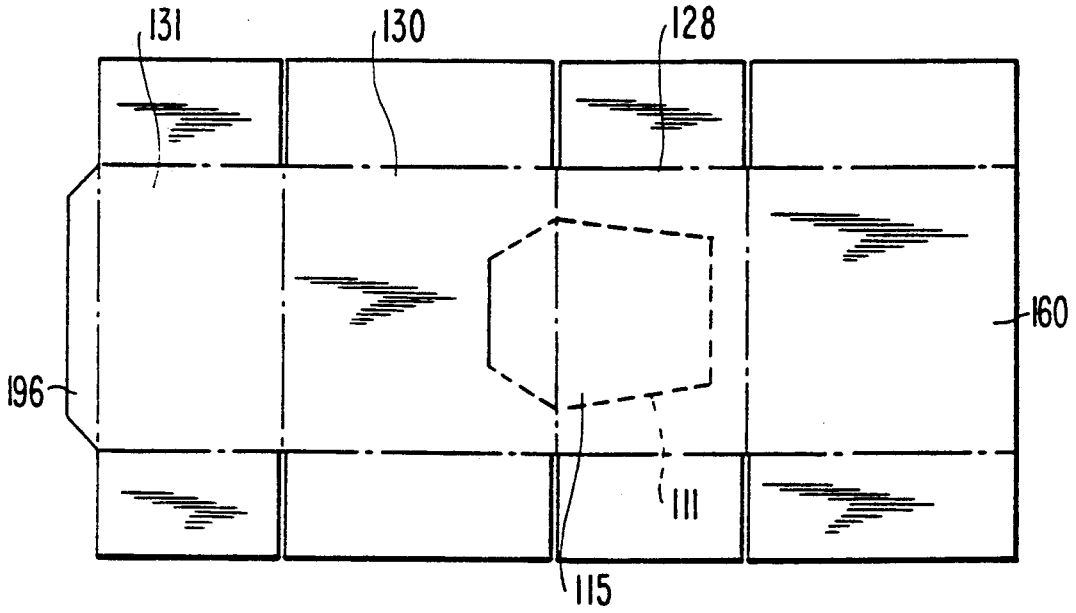
FIG. 10 is a plan view of the carton blank from which the carton of FIG. 6 can be prepared.

The carton blank used to form carton 126 is seen in FIG. 10. The blank comprises a bottom panel 160, a front panel 128, top panel 130 and rear panel 131. Perforated lines 111 define the access flap 115. Glue flap 196 is appended to rear flap 131 for gluing rear flap 131 to bottom flap 160.

A stack of sheets is loaded into carton 126 in the same manner as shown in FIG. 5 with respect to carton 26.

Figure 6:
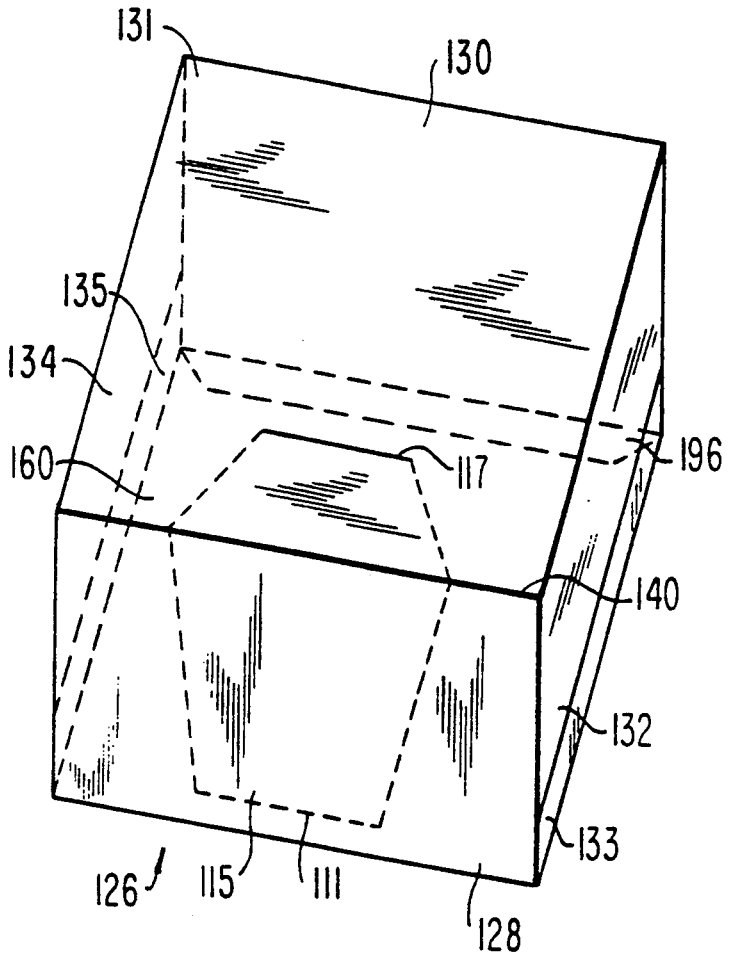
FIG. 6 is a perspective view of an alternate carton of the invention.
Figure 11:
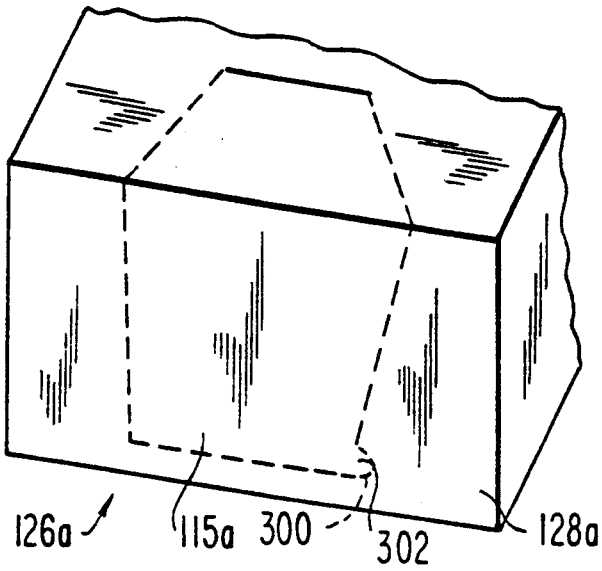
FIG. 11 is a partial perspective view of the carton of FIG. 6 having an access opening according to an alternate embodiment.
Figure 12:
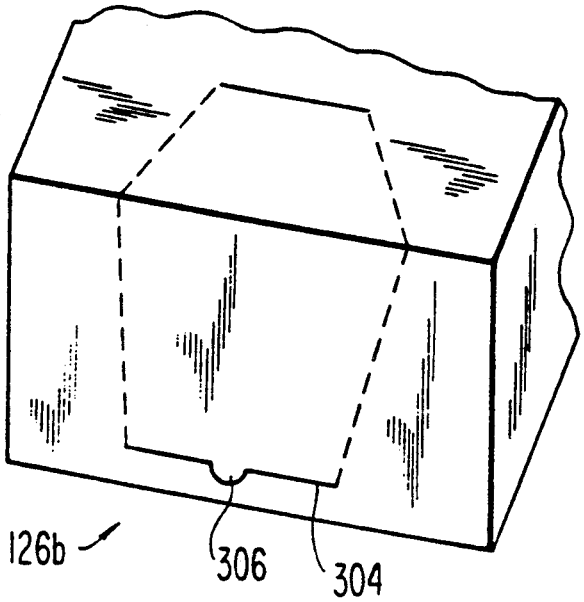
FIG. 12 is a partial perspective view of the carton of FIG. 6 having an access opening according to a further alternate embodiment.
Figure 13:
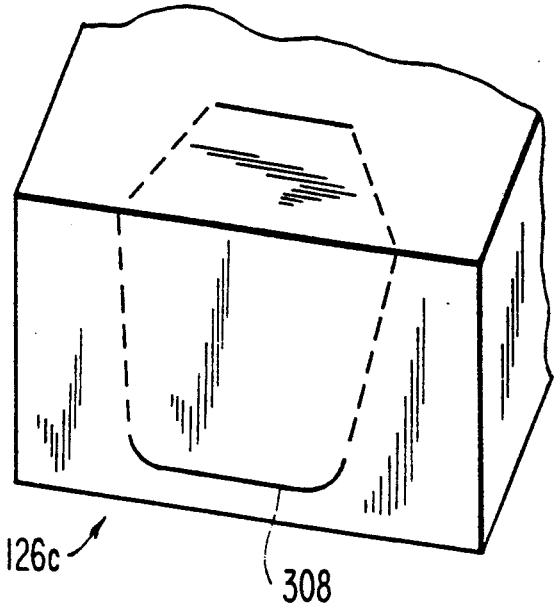
FIG. 13 is a partial perspective view of the carton of FIG. 6 having an access opening according to another alternate embodiment.
Figure 14A:
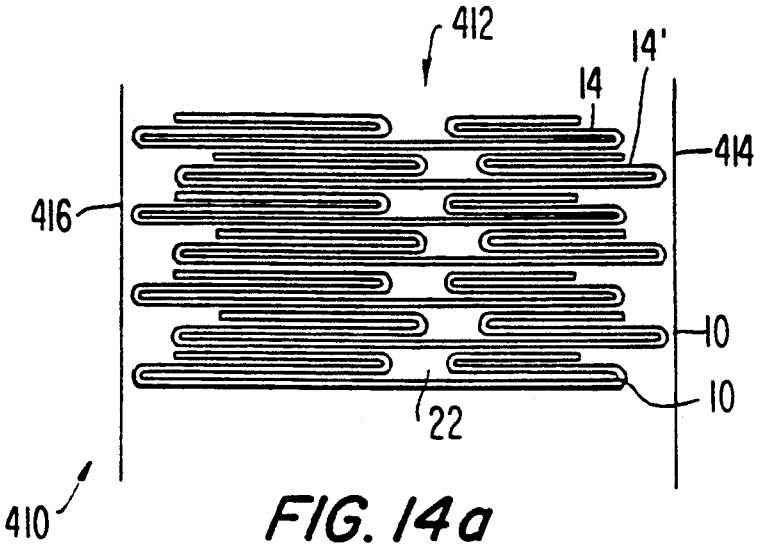
FIG. 14*a* is a front view of a stack of dryer sheets according to the invention.
Figure 14B:
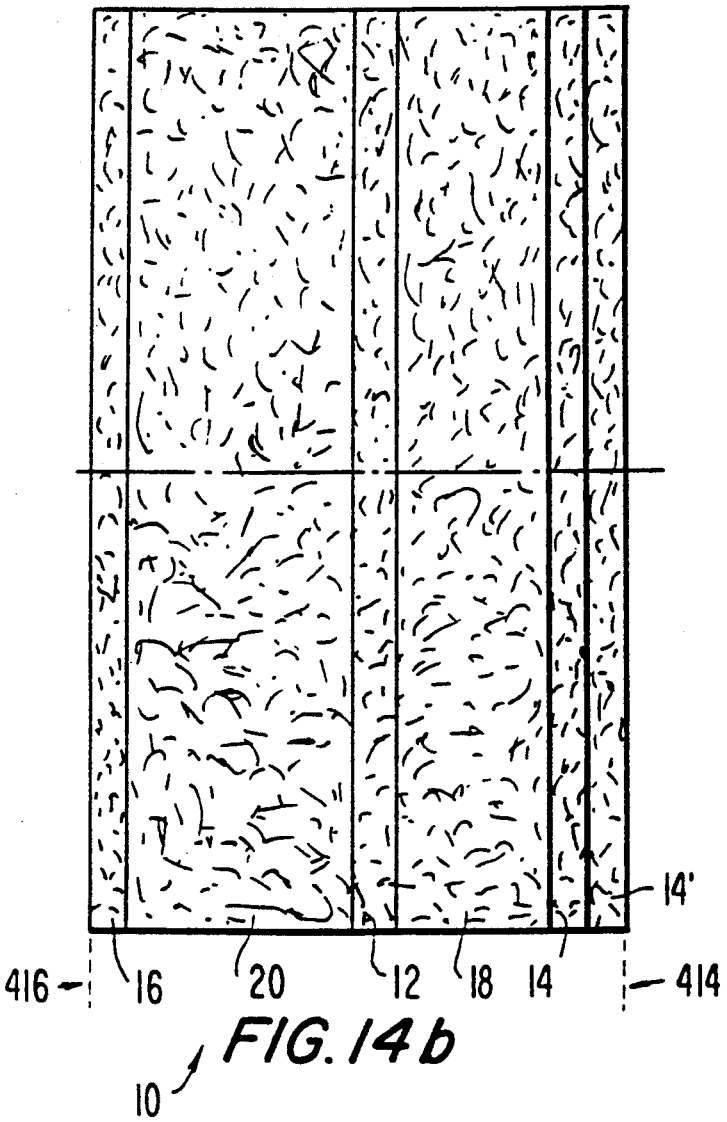
FIG. 14*b* is a top plan view of the stack of FIG. 14*a*.

FIGS. 11–13 show alternate embodiments of the access opening shown in FIG. 6. Cartons **126*a*, 126*b* and 126*c* are the same as carton 126, except as noted below. In FIG. 11, product access flap 115*a* includes in its lower right hand corner a rounded cut 300 which facilitates opening of the access flap by defining a depressable tab 302**.

In carton **126*b* of FIG. 12, the bottom periphery 304 is cut to include a rounded tab 306. In carton 126*c* of FIG. 13, the rounded bottom cut 308** eases opening of the carton.

The sheets within a stack may be offset. By offset it is meant that the sheets do not lie directly on top of each other. As seen in FIG. **14*a*, the stack 410 comprises sheets 10** which lie on top of each other in an arrangement wherein each sheet is offset in a transverse direction from that above. As a result, alternating sheets are disposed with their edges in the same plane.

When viewed from above as in FIG. **14*b*, sheet 10 can be seen as well as a portion of intermediate layer 14'** of the underlying sheet. Preferably, the sheets are offset by at least 5% of their width, preferably at least 9% of their width.

The stack is then folded into the "U" shape along the transverse axis for dispensing and inserted into a carton so that the top 412 of the stack faces a dispensing opening in the carton. It is believed that because of the offsets, the opening of the carton sees an effective stack width equal to the distance between the plane 414 passing through the most remote edges of one side of the stack and the plane 416 passing through the remote edges of the sheets on the other end of the stack. As a result, the stack remains secure within the carton even after the opening has been formed. However, the individual sheets see an opening which is wider than would otherwise be possible and are more readily removed.

Although the stack is illustrated as being folded along the transverse axis, this is not imperative. The benefit of this aspect of the invention is obtained so long as the sheets are dispensed from a stack wherein a substantial number of sheets are offset from the sheets, if any, immediately above or below along the surface of the sheets facing the opening of the carton so that the stack has an effective distance along the surface facing the opening which is greater than the comparable end to end distance of any of the sheets. Preferably the distance is measured along the same axis as the axis of the opening, if the opening has an axis which is longer in one direction than in the other, e.g., if the opening is rectangular or oval. It is preferred that at least 20%, especially 40% of the sheets are offset with respect to at least the sheet immediately above or immediately below. It is especially preferred that at least 50% of the sheets are offset with respect to the sheet, if any, immediately above and the sheet, if any, immediately below. Ideally at least 90% of the sheets are offset with respect to the sheet, if any, immediately above and the sheet, if any, immediately below.

Figure 15A:
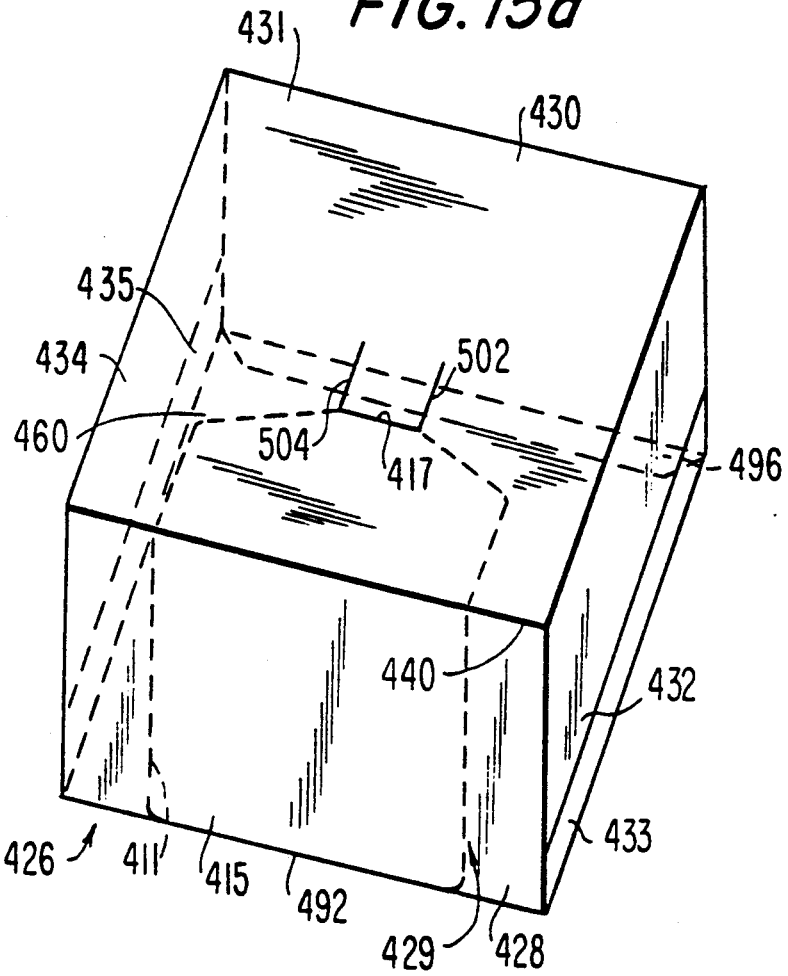
FIG. 15*a* is a perspective view of an alternate preferred carton for use in the invention.
Figure 16:
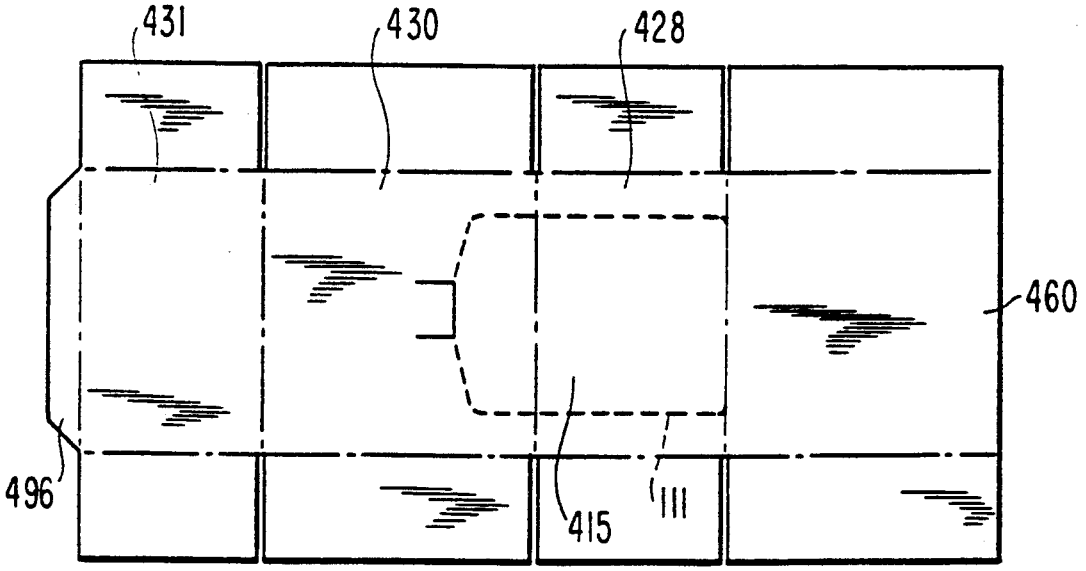
FIG. 16 is a plan view of the carton blank from which the carton of FIG. 15*a* can be prepared.

An alternate preferred carton is illustrated in FIGS. **15*a* and 15*b*. FIG. 16 shows the carton blank from which the carton may be prepared. Carton 426 comprises front panel 428, outer major side flap 432, inner major side flap 433, second outer major side flap 434, second inner major side flap 435, rear panel 431 and bottom panel 460. Perforated lines 411 define a product access flap 415 which is permanently joined to the bottom panel 460 by score line 492. As can be seen particularly in FIG. 15*a*, access flap 415 comprises portions both of front panel 428 and top panel 430, including a portion of score line 440** which separates the top from the front panels.

To facilitate opening of the carton by the consumer, top panel 430 includes two generally parallel cut lines 502, 504, and a third, cut line 417 perpendicular to and connecting the other two. Together, lines 502, 504 and 417 define a tab 508 in top panel 430 which more readily permits the consumer to tear open access flap 415.

As with the prior embodiments, the access flap is designed so that when the dryer sheets are fully loaded within the carton in the "U" orientation wherein the bight or inflection point 400 faces the access opening as in FIG. 5, the ratio of the access opening to the width of the dryer sheets or the overall width of the stack of sheets is within a defined range. In particular, it is preferred that the ratio is within the range of about 0.55 to about 0.76, especially about 0.7 to about 0.75, and most preferably about 0.73 to about 0.74. Design of the carton in accordance with the above ratios is believed to facilitate removal of the sheets by the consumer.

The ratio of the area of the plane of the folded sheet or the plane encompassing the overall effective area of the stack seen by the opening (in the case of offset stacking) to the area of the access opening is preferably within the range of 1:2.5 to 1:5.0.

Advantageously, access flap 415 includes 2 hinges. Both score lines 440 and 492 of the access flap serve as hinges.

Figure 15B:
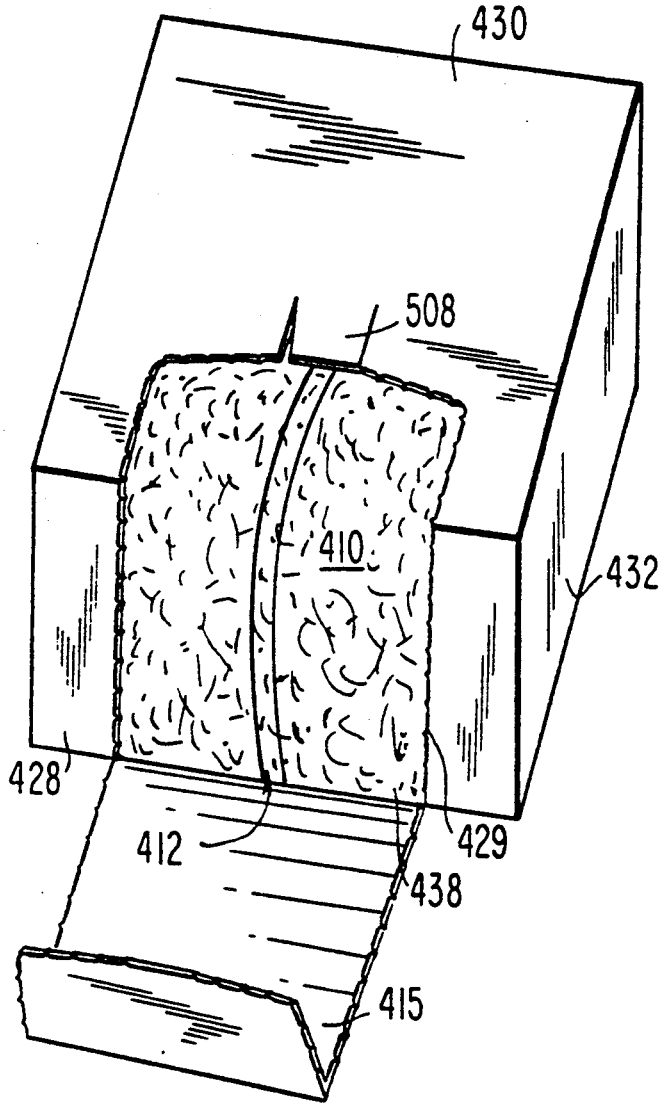
FIG. 15*b* is a perspective view of the carton of FIG. 15*a* having the access flap in the open position.

When it is desired to use one of the fabric softener sheets, the consumer will press against tab 508. The presence of the tab will permit the consumer to place his/her finger below the upper portion of access flap 415 and grasp it. Perforations 411 will permit severance of the connections between the access flap and the front panel 428 and top panel 430 except for score line 492 wherein the access flap will remain attached to the bottom panel. Once the perforations have been severed, the flap will remain opened as seen in FIG. 15*b*. Behind flap 415, dryer sheet 410 can be seen.

Severance of the perforations 411 creates product access opening 438. When the consumer desires to remove a sheet, he/she will grasp the fabric softening sheet at gap 412. The width of the access opening at 429, which constitutes the bight of the full stack of dryer sheets is within the ratio defined above to facilitate removal of the sheets. The dimensions of the carton may be within the ranges defined above.

When the consumer has removed the dryer sheet from the carton, the carton may be reclosed by grasping access flap 415 and pushing it upwardly inside aperture 438. The presence of the two hinges permits the access flap readily to stay within the access aperture when so positioned.

The use of a reclosable flap is for minimizing unwanted escape of perfume into the air when the sheets are not being used and helps protect the sheet from moisture and other elements in the air.

It should be understood, of course, that the specific forms of the invention herein illustrated and described are intended to be representative only as certain changes may be made therein without departing from the clear teachings of the disclosure. Accordingly, reference should be made to the following appended claims in determining the full scope of the invention.

What is claimed is:

1. A carton containing therein a stack of individual, separate fabric softener sheets which are not interleaved, said stack overall forming a generally U-shape having a bight, said carton including a top panel and a front panel, said front and top panels including lines of weakness defining a reclosable access flap, one of said front or top panels including a first score line defining a hinge by which said access flap is permanently attached to said top or front panel, a panel-separating scoreline separating said front and top panels, at least a portion of said panel separating scoreline traversing said access flap whereby said portion of the panel-separating scoreline traversing said access flap is positioned to act as a second hinge for opening and reclosure of said access flap said bight facing the access aperture said carton not containing an insert supporting the stack of individual sheets, said sheets being offset prior to forming the U-shape.

2. The carton according to claim 1 wherein the ratio of the width of the access aperture at the bight of the stack to the width of the stack of sheets is between about 0.55 to about 0.76.

3. The carton according to claim 2 wherein the ratio is from about 0.7 to about 0.75.

4. The carton according to claim 1 wherein said sheets are each individually folded to form a dove tail.

5. The carton according to claim 1 wherein said sheets are dryer softener sheets.

6. The carton according to claim 1 wherein at least 20% of the sheets are offset from the sheet directly above or the sheet directly below.

7. The carton according to claim 6 wherein at least 50% of said sheets are offset in a transverse direction with respect to the sheet, if any, immediately above and with respect to the sheet, if any, immediately below.

8. The carton of claim 1 wherein said first score line comprises the score line separating the bottom panel from the front panel and the second score line is the score line separating the front panel from the top panel.

9. The carton of claim 8 wherein said top panel further comprises a depressable tab adjacent said access flap.

10. A carton containing therein a stack of individual, separate fabric softener sheets, said stack overall forming a generally U-shape having a bight, said carton including a top panel and a front panel, said front and top panels including lines of weakness defining a reclosable access flap, one of said front or top panels including a first score line defining a hinge by which said access flap is permanently attached to said top or front panel, a panel-separating scoreline separating said front and top panels, at least a portion of said panel separating scoreline traversing said access flap whereby said portion of the panel-separating scoreline traversing said access flap is positioned to act as a second hinge for opening and reclosure of said access flap said bight facing the access aperture, said sheets being offset prior to forming the U-shape.

* * * * *